US008899725B2

(12) United States Patent
Matsuzaki et al.

(10) Patent No.: US 8,899,725 B2
(45) Date of Patent: Dec. 2, 2014

(54) RECORDING APPARATUS

(71) Applicant: Seiko Epson Corporation, Tokyo (JP)

(72) Inventors: Kazutoshi Matsuzaki, Shiojiri (JP); Kazumasa Harada, Matsumoto (JP); Yoshiyuki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/936,079

(22) Filed: Jul. 5, 2013

(65) Prior Publication Data

US 2014/0009541 A1 Jan. 9, 2014

(30) Foreign Application Priority Data

Jul. 6, 2012 (JP) ..... 2012-152568
Aug. 10, 2012 (JP) ..... 2012-178281

(51) Int. Cl.
*B41J 2/14* (2006.01)
*B41J 2/175* (2006.01)

(52) U.S. Cl.
CPC ..... *B41J 2/1752* (2013.01)
USPC ..... 347/49; 347/85

(58) Field of Classification Search
USPC ..... 347/49, 85, 86, 87
See application file for complete search history.

(56) References Cited

U.S. PATENT DOCUMENTS

| | | | | |
|---|---|---|---|---|
| 6,250,750 | B1 | 6/2001 | Miyazawa et al. | |
| 6,302,535 | B1 * | 10/2001 | Sturgeon et al. | 347/86 |
| 6,312,105 | B1 | 11/2001 | Miyauchi | |
| 6,955,422 | B2 * | 10/2005 | Miyazawa et al. | 347/86 |
| 7,802,877 | B2 * | 9/2010 | Hashii et al. | 347/85 |
| 7,837,311 | B2 * | 11/2010 | Hattori et al. | 347/86 |
| 7,944,910 | B2 * | 5/2011 | Umeda | 370/352 |
| 2005/0146576 | A1 | 7/2005 | Shinada et al. | |

FOREIGN PATENT DOCUMENTS

| | | |
|---|---|---|
| JP | 07-246716 | 9/1995 |
| JP | 07-314660 | 12/1995 |
| JP | 10-109427 | 4/1998 |
| JP | 2000-127427 | 5/2000 |
| WO | WO99/59823 | 11/1999 |

* cited by examiner

*Primary Examiner* — Anh T. N. Vo
(74) *Attorney, Agent, or Firm* — Workman Nydegger

(57) ABSTRACT

A cartridge mounting mechanism includes a chamber that accommodates therein a cartridge introduced through a cartridge inlet formed as an opening directed upward, a biasing mechanism that biases the cartridge set in the chamber in an upward direction corresponding to a removal direction of the cartridge, and a holding mechanism configured to be engaged with the cartridge so as to restrict, against a biasing force of the biasing mechanism, the cartridge from moving in the removal direction when the cartridge is set in the chamber, and disengaged from the cartridge to release the cartridge from the restriction against the biasing force, upon being subjected to an external operating force.

9 Claims, 10 Drawing Sheets

RECORDING APPARATUS

BACKGROUND

1. Technical Field

The present invention relates to a recording apparatus incorporated with the cartridge mounting mechanism.

2. Related Art

Recording apparatuses thus far developed that perform a recording operation on a medium with a recording material include an ink jet printer (hereinafter, simply "printer"). The printer ejects a liquid, an example of the recording material, from a recording head to the medium thereby performing the recording operation. Among the printers thus designed, those that employ an ink cartridge containing ink, an example of the liquid, to be replaced for recharging the ink generally include a cartridge holder on which the ink cartridge can be removably mounted.

Some of the existing cartridge holders include a cartridge inlet formed as an opening directed upward at the upper edge of the chamber in which the ink cartridge is set, and a lever that serves as the lid that covers the cartridge inlet. The lever is opened and closed thus to open and close the cartridge inlet, and when the lever is in the closed position the ink cartridge is depressed by the lever in the mounting direction, and thus restricted from wobbling (for example, see International Publication No. WO 1999/059823).

However, the lever has to be operated each time the ink cartridge is mounted or removed, and hence the operation often becomes troublesome especially when a plurality of ink cartridges have to be mounted or removed.

Further, the mentioned drawback is incidental not only to the cartridge holder and the printer incorporated with the cartridge holder, but broadly to cartridge mounting mechanisms in which cartridges containing a recording material are removably mounted and recording apparatuses incorporated with the cartridge mounting mechanism.

SUMMARY

An advantage of some aspects of the invention is provision of a cartridge mounting mechanism that offers higher operability in mounting and removing a cartridge containing a recording material, and a recording apparatus incorporated with such a cartridge mounting mechanism.

In an aspect, the invention provides a recording apparatus including a recording head that ejects a liquid; a cartridge mounting mechanism including (i) a chamber that accommodates therein a cartridge introduced through a cartridge inlet of the chamber, the cartridge inlet being an opening directed upward, (ii) a biasing mechanism that biases the cartridge set in the chamber in an upward direction corresponding to a removal direction of the cartridge, and (iii) a holding mechanism configured to be (a) engaged with the cartridge so as to restrict, against a biasing force of the biasing mechanism, the cartridge from moving in the removal direction when the cartridge is set in the chamber, and (b) disengaged from the cartridge to release the cartridge from the restriction against the biasing force, upon being subjected to an external operating force; and a carriage that reciprocates in a main scanning direction, with the recording head and the cartridge mounting mechanism mounted thereon.

With the mentioned configuration, when the holding mechanism is subjected to an operating force while the cartridge is in the chamber, the holding mechanism, thus far engaged with the cartridge to restrict the movement thereof, releases the cartridge from the restriction. Accordingly, the cartridge is allowed to move in the removal direction by the biasing force of the biasing mechanism. In contrast, although the cartridge is subjected to the biasing force of the biasing mechanism acting in the removal direction while the cartridge is in the chamber, the holding mechanism is engaged with the cartridge against the biasing force, to thereby restrict the cartridge from moving in the removal direction. Such a configuration allows the cartridge to be mounted and removed, without the need to provide a member that covers the cartridge inlet. Consequently, the trouble of opening and closing the member covering the cartridge inlet can be eliminated, and thus the operability in mounting and removing the cartridge can be improved.

In the foregoing recording apparatus, preferably, the holding mechanism may include an operating lever pivotably attached to the chamber at a position close to the cartridge inlet, and the operating lever may include a manipulating portion located in an upper region of the pivotal center to be subjected to an external operating force, and an engaging portion located in a lower region of the pivotal center to be engaged with the cartridge.

In the mentioned configuration, the holding mechanism having the operating lever is attached to the chamber, therefore the cartridge can be made smaller in size compared with the case of providing an operating lever having similar functions on the side of the cartridge.

In the foregoing recording apparatus, preferably, the biasing mechanism may possess a biasing force sufficient to allow the cartridge to move, when the cartridge is released from the restriction of the engaging portion against the biasing force, to a removal position where a part of the cartridge is exposed upward from the cartridge inlet, and the holding mechanism may be configured to be engaged, against the gravity, with the cartridge that has been moved by the biasing force of the biasing mechanism, to thereby retain the cartridge in the removal position.

With the mentioned configuration, when the cartridge is released from the restriction of the engaging portion against the biasing force and thus displaced to the removal position, the cartridge is retained in the removal position because the holding mechanism is engaged with the cartridge against the gravity. Therefore, a user can visually recognize instantly that the cartridge has been released from the restriction against moving in the removal direction. In addition, since a part of the cartridge is exposed upward from the cartridge inlet the cartridge can be easily caught, which leads to improved operability in removing the cartridge.

In the foregoing recording apparatus, preferably, the operating lever may include a sloped portion inclined inwardly of the chamber and formed from a position close to the pivotal center toward the engaging portion, and the holding mechanism may further include a biasing member that biases a lower end portion of the operating lever toward an inner region of the chamber.

With the mentioned configuration, when the lower end portion of the operating lever is made to pivot inwardly of the chamber by the biasing force of the biasing member, the sloped portion sticks out inwardly of the chamber together with the engaging portion. Therefore, the cartridge can be retained in the removal position by the sloped portion sticking out inwardly of the chamber.

Preferably, the foregoing recording apparatus may further include an apparatus-side connection terminal, and the cartridge may include a cartridge-side connection terminal. The apparatus-side connection terminal may include a movable contact member disposed to stick out inwardly of the chamber when the cartridge is not accommodated and to be elastically deformed upon being contacted by the cartridge-side connection terminal of the cartridge introduced into the chamber, to an extent according to a contact pressure of the cartridge-side connection terminal, and the movable contact member may act as the biasing mechanism.

The mentioned configuration eliminates the need to provide an exclusive biasing member that biases the cartridge upward, i.e., in the removal direction, since the movable contact member of the apparatus-side connection terminal constitutes a part of the biasing mechanism.

The foregoing recording apparatus may further include a main casing including an opening located above the stroke region of the carriage in the main scanning direction and having a shape corresponding to the stroke region. The opening may include a cutaway portion formed at a position corresponding to a mounting/removing position of the cartridge in the main scanning direction, so as to allow the manipulating portion of the cartridge mounting mechanism to be exposed, and the main casing covers the manipulating portion in a region other than the mounting/removing position.

With the mentioned configuration, the main casing covers the manipulating portion of the cartridge mounting mechanism in the stroke region of the carriage except for the mounting/removing position, which disables the cartridge from being removed. At the mounting/removing position, on the other hand, the manipulating portion can be reached for operation through the cutaway portion of the opening.

The foregoing recording apparatus may include a liquid tank provided outside of the stroke region, and a liquid supply tube connecting between the liquid tank and the cartridge.

With the mentioned configuration, when the holding mechanism is subjected to an operating force while the cartridge is in the chamber, the holding mechanism, thus far engaged with the cartridge to restrict the movement thereof, releases the cartridge from the restriction. Accordingly, the cartridge is allowed to move in the removal direction by the biasing force of the biasing mechanism. In contrast, although the cartridge is subjected to the biasing force of the biasing mechanism acting in the removal direction while the cartridge is in the chamber, the holding mechanism is engaged with the cartridge against the biasing force, to thereby restrict the cartridge from moving in the removal direction. Such a configuration allows the cartridge to be mounted and removed, without the need to provide a member that covers the cartridge inlet. Consequently, the trouble of opening and closing the member covering the cartridge inlet can be eliminated, and thus the operability in mounting and removing the cartridge can be improved. Further, mounting the cartridge including the liquid supply path on the cartridge mounting mechanism allows the liquid stored in the liquid tank located outside of the stroke region of the carriage to be supplied to the recording head through the liquid supply tube. Supplying thus the liquid from the liquid tank having a larger capacity than the cartridge containing the liquid allows the recording operation to be successively performed.

Preferably, the foregoing recording apparatus may include the main casing including the opening located above the stroke region of the carriage and having the shape corresponding to the stroke region. The liquid tank may be located outside of the main casing, and the liquid supply tube may be introduced into the main casing through the opening from outside of the main casing.

With the mentioned configuration, since the main casing includes the opening, the liquid supply tube can be introduced into the main casing through the opening from outside of the main casing. Further, since the liquid tank is located outside of the main casing, the shape and the capacity of the liquid tank can be designed free from the restriction otherwise imposed by the shape and size of the main casing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereafter, the recording apparatus according to the invention embodied as an ink jet printer will be described, with reference to the drawings.

Figure 1:
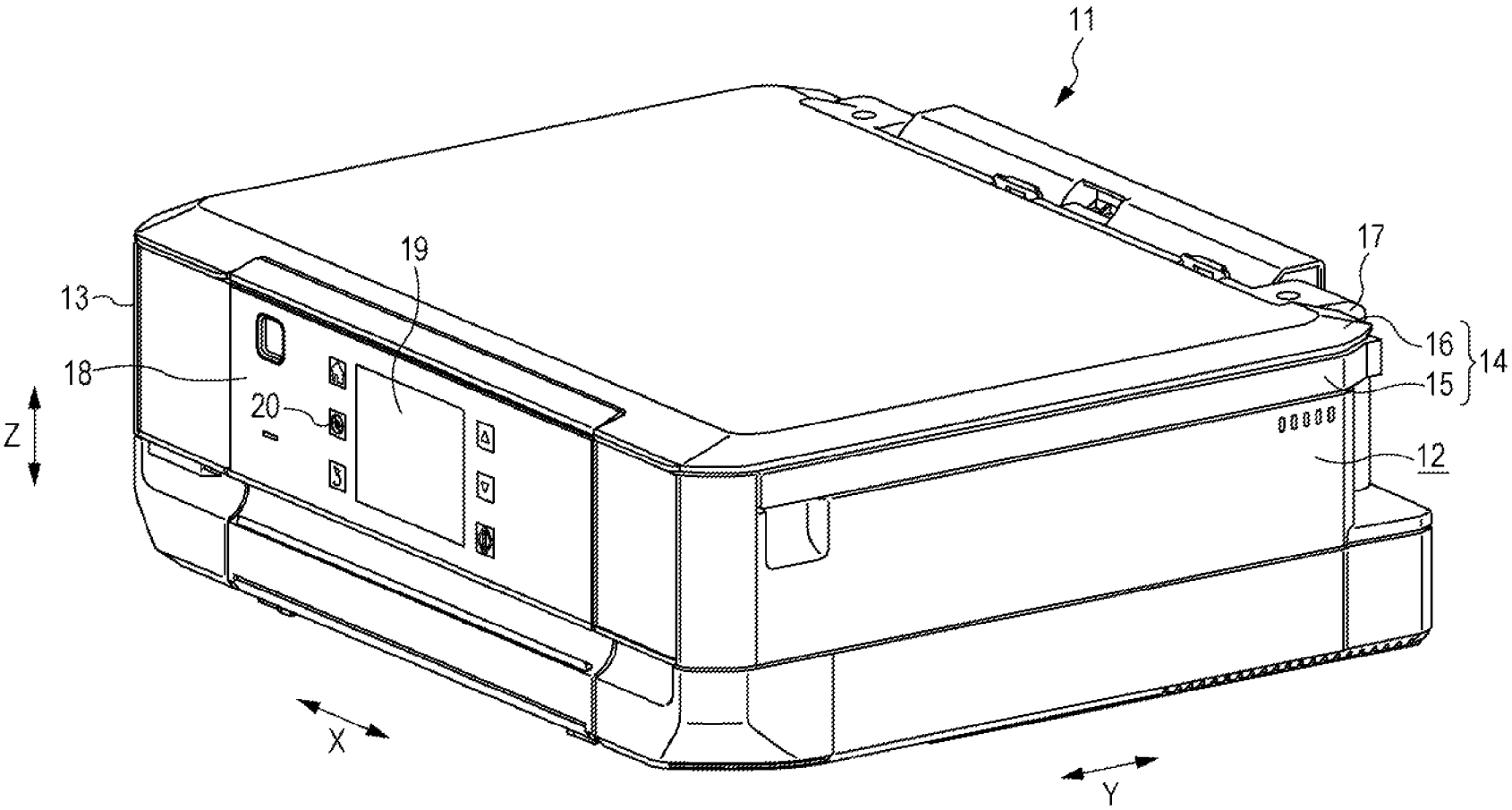
FIG. 1 is a perspective view showing a multifunction printer incorporated with a recording apparatus according to a first embodiment of the invention.

As shown in FIG. 1, a multifunction printer 11 includes a recording apparatus 12, and a scanner unit 14 superposed thereon in the anti-gravity direction and coupled to a main casing 13 of the recording apparatus 12. In the following description, the anti-gravity direction will be referred to as upward direction and the gravity direction will be referred to as a downward direction. In addition, a direction along the up and downward direction will be indicated as up-down direction Z in the drawings.

The scanner unit 14 includes a scanner main body 15 coupled to the recording apparatus 12, and a cover 16 provided on the upper side of the scanner main body 15. The scanner unit 14 can be opened and closed with respect to the main casing 13 via a pivotal mechanism 17 such as a hinge provided at an end portion of the scanner unit 14.

In the following description, the side of the multifunction printer 11 on which the pivotal mechanism 17 is located will be referred to as rear side, and the opposite side will be referred to as front side. A direction along the forward or backward direction will be indicated as front-back direction Y in the drawings. Further, a direction intersecting the front-back direction Y and the up-down direction Z (in this embodiment, orthogonal) will be indicated as width direction X in the drawings. The scanner main body 15 can be opened by making the front edge thereof pivot upward.

An operation panel 18 is provided on the front face of the main casing 13. A display unit (for example, an LCD) 19 that displays a menu screen and so forth and operating buttons 20 are located on the front face of the operation panel 18.

Figure 2:
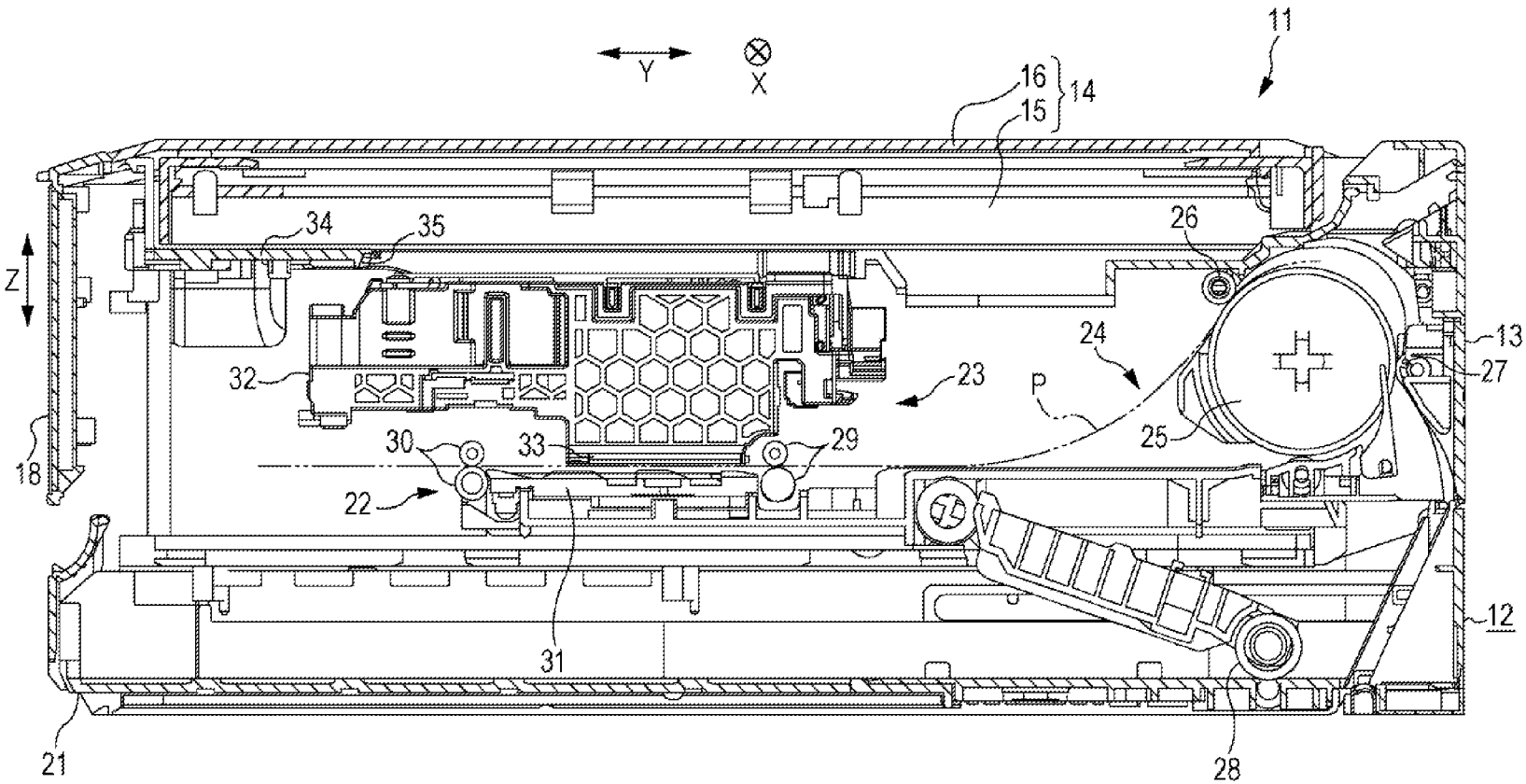
FIG. 2 is a cross-sectional view of the multifunction printer shown in FIG. 1.

As shown in FIG. 2, a sheet cassette 21 that carries a plurality of paper sheets P is removably mounted on the inner bottom portion of the main casing 13. In addition, a transport mechanism 22 configured to transport the paper sheet P, and a recording unit 23 that performs a recording operation onto the paper sheet P transported by the transport mechanism 22 are installed inside of the main casing 13.

The transport mechanism 22 includes a feeding mechanism 24 that feeds the paper sheets P placed in the sheet cassette 21 one by one to the recording unit 23. The feeding mechanism 24 includes a feed drive roller 25, a feed slave roller 26 that follows the rotation of the feed drive roller 25 with the paper sheet P pinched therebetween, a splitting roller 27, and a pickup roller 28.

The transport mechanism 22 also includes a transport roller pair 29 that transports the paper sheet P delivered from the feeding mechanism 24 to the recording unit 23, and a discharge roller pair 30 that discharges the paper sheet P that has undergone the recording operation by the recording unit 23. Further, a support member 31 that supports the paper sheet P is provided between the transport roller pair 29 and the discharge roller pair 30 in the front-back direction Y along the transport direction.

A carriage 32 included in the recording unit 23 is installed above the support member 31 inside of the main casing 13, so as to reciprocate in the main scanning direction, which is the width direction X. A recording head 33 that ejects ink, exemplifying the recording material in the invention, is mounted on the lower face of the carriage 32. Thus, when the recording head 33 ejects ink droplets onto the paper sheet P transported by the transport mechanism 22 to the position on the support member 31, the recording operation is performed.

The upper wall 34 of the main casing 13 includes an opening 35 located above the stroke region of the carriage 32 along the main scanning direction and having a shape corresponding to the stroke region. When the scanner unit 14 is opened, the upper side of the carriage 32 is exposed through the opening 35 formed in the upper wall 34 of the main casing 13.

Figure 3:
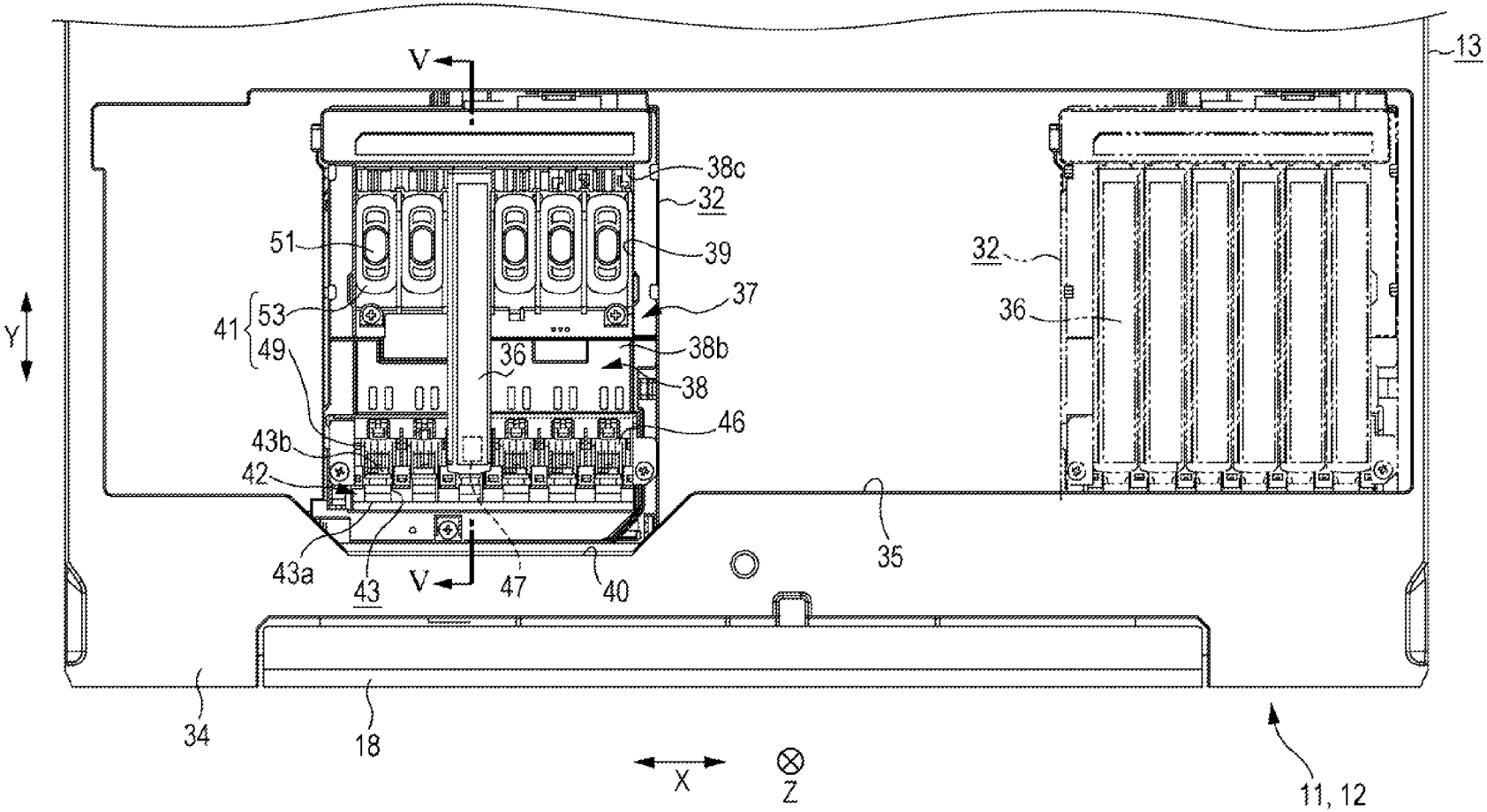
FIG. 3 is a plan view of a main casing according to the first embodiment.

As shown in FIG. 3, a cartridge mounting mechanism 37 on which a cartridge 36 storing therein the ink can be removably mounted is installed on the carriage 32. The cartridge mounting mechanism 37 includes a chamber 38 in which the cartridge 36 can be accommodated. Here, the chamber 38 is configured to accommodate a plurality (in this embodiment, six pieces) of cartridges 36 aligned in the width direction X.

The chamber 38 includes a cartridge inlet 39 which is an opening directed upward. The cartridge mounting mechanism 37 is not provided with a member that covers the cartridge inlet 39. Therefore, the cartridge 36 can be introduced into the chamber 38 through the cartridge inlet 39, because the upper side of the carriage 32 is exposed.

Here, the opening 35 includes a cutaway portion 40 formed in the vicinity of an end portion (on the left in FIG. 3) of the front side extending in the width direction X. The position of the cutaway portion 40 corresponds to a mounting/removing position where the carriage 32 is located when the cartridge 36 is mounted or removed.

Hereunder, configuration of the cartridge mounting mechanism 37 will be described in further details.

The cartridge mounting mechanism 37 includes a biasing mechanism 41 that biases the cartridge 36 set in the chamber 38 upward, i.e., in the removal direction, and a holding mechanism 42 that retains the cartridge 36 set in the chamber 38 against the biasing force of the biasing mechanism 41.

The holding mechanism 42 includes an operating lever 43 pivotably attached to a position on the side of the cartridge inlet 39 of the chamber 38 in the up-down direction Z, and on the front side of the chamber 38 in the front-back direction Y. The operating lever 43 includes a manipulating portion 43*a* to be subjected to an external operating force and provided in an upper region of the pivotal center, and an engaging portion 43*b* to be engaged with the cartridge 36 and provided in a lower region of the pivotal center.

The cutaway portion 40 in the opening 35 allows the manipulating portion 43*a* provided in the cartridge mounting mechanism 37 for receiving an external operating force to be exposed, at the mounting/removing position in the main scanning direction where the cartridge 36 is to be mounted or removed. In contrast, the main casing 13 serves to cover the manipulating portion 43*a* in the region other than the mounting/removing position. Accordingly, when the carriage 32 is located at the mounting/removing position as shown in FIG. 3, the manipulating portion 43*a* of the operating lever 43 is exposed through the cutaway portion 40, and hence can be reached for operation. On the other hand, when the carriage 32 is deviated from the mounting/removing position as indicated by dash-dot-dot lines in FIG. 3, the manipulating portion 43*a* of the operating lever 43 is hidden below the upper wall 34 of the main casing 13 and hence cannot be reached.

Figure 4:
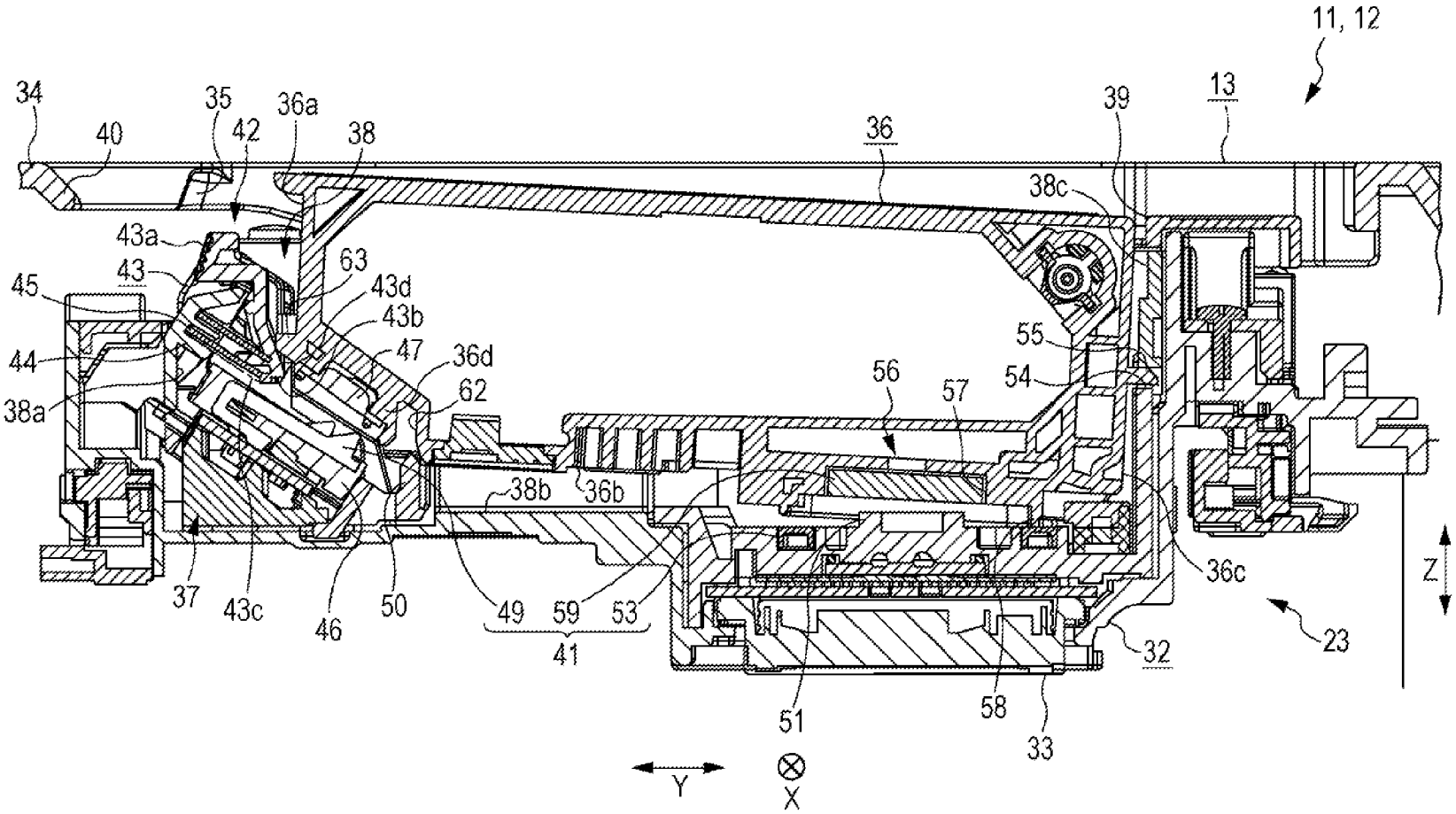
FIG. 4 is a cross-sectional view of a cartridge mounting mechanism according to the first embodiment.

As shown in FIG. 4, the operating lever 43 includes the engaging portion 43*b* formed on the rear side of the lower portion facing the inside of the chamber 38 (on the right in FIG. 4), and a spring engagement portion 43*c* formed on the front side (on the left in FIG. 4). The operating lever 43 also includes a sloped portion 43*d* formed in the portion facing the inside of the chamber 38 and inclined inwardly of the chamber 38 from the pivotal center toward the engaging portion 43*b*.

The chamber 38 includes a spring hook portion 44 projecting obliquely downward from a position on the inner front wall 38*a* corresponding to the cartridge inlet 39 in the up-down direction Z. Further, a coil spring 45, exemplifying the biasing member in the invention, is provided between the spring hook portion 44 and the spring engagement portion 43*c* of the operating lever 43, so as to bias the lower end portion of the operating lever 43 toward an inner portion of the chamber 38.

An apparatus-side connection terminal 46 is provided in the vicinity of the front end portion of the inner bottom portion 38*b* of the chamber 38. The apparatus-side connection terminal 46 includes a plurality of movable contact members 49 disposed to stick out into the chamber 38 when the cartridge is not accommodated in the chamber 38. The movable contact member 49 is elastically deformed upon being contacted by a cartridge-side connection terminal 47 of the cartridge 36 introduced into the chamber 38, to an extent according to the contact pressure of the cartridge-side connection terminal 47. In this embodiment, the movable contact member 49 is formed of a metal material configured to serve as a leaf spring.

The cartridge-side connection terminal 47 is connected to a circuit board (not shown) storing therein various information such as the volume of the ink in the cartridge 36. The apparatus-side connection terminal 46 is electrically connected to a control unit (not shown) installed in the multifunction printer 11. When the cartridge-side connection terminal 47 enters into contact with the movable contact member 49 of the apparatus-side connection terminal 46, the connection terminals 46, 47 are electrically connected to each other, so that various types of information is exchanged between the circuit board of the cartridge 36 and the control unit of the multifunction printer 11.

A stopper pin 50 projecting upward is provided on the inner bottom portion 38*b* of the chamber 38 and at the rear of the apparatus-side connection terminal 46. In addition, a liquid introduction path 51 to be connected to the cartridge 36 when the cartridge 36 is set in the chamber 38 is provided on the inner bottom portion 38*b* in the vicinity of the rear end portion thereof.

A seal member 53 of an annular shape is provided so as to surround the liquid introduction path 51. The seal member 53 is formed of an elastic material such as a synthetic rubber, and serves to restrict the ink from leaking when the liquid introduction path 51 is connected to the cartridge 36. In addition, the chamber 38 includes an engagement hole 54 formed on the inner rear wall 38*c* at a generally central position thereof in the up-down direction Z.

Hereunder, the cartridge 36 will be described in further details.

The cartridge 36 has a generally rectangular block shape, and is mounted on the cartridge mounting mechanism 37 such that the longitudinal direction of the cartridge 36 is aligned with the front-back direction Y. Here, the face of the cartridge 36 opposing the inner front wall 38*a* when the cartridge 36 is placed in the chamber 38 will be referred to as front face 36*a*, the face opposing the inner bottom portion 38*b* will be referred to as bottom face 36*b*, and the face opposing the inner rear wall 38*c* will be referred to as rear face 36*c*. The cartridge 36 includes a sloped face 36*d* located between the front face 36*a* and the bottom face 36*b*.

The cartridge 36 includes an engaging projection 55 formed on the rear face 36*c*, so as to be fitted in the engagement hole 54. In addition, a liquid supply unit 56 is provided in the bottom face 36*b* of the cartridge 36, at a position in the vicinity of the rear end portion thereof.

The liquid supply unit 56 includes a liquid delivery port 57 through which the ink in the cartridge 36 is delivered, and an annular projection 58 projecting from the bottom face 36*b* of the cartridge 36 so as to surround the liquid delivery port 57. Further, the liquid delivery port 57 includes a delivery member 59 formed of a foamed resin or the like.

When the cartridge 36 is introduced in the chamber 38, first the annular projection 58 is made to abut the seal member 53 of the liquid introduction path 51, to thereby elastically deform the seal member 53. Then the delivery member 59 in the liquid delivery port 57 is brought into contact with the liquid introduction path 51, so that the ink can be delivered out of the cartridge 36 to the chamber 38.

When the liquid delivery port 57 of the cartridge 36 is connected to the liquid introduction path 51 of the cartridge mounting mechanism 37, the counterforce originating from the elastic deformation of the seal member 53 and the delivery member 59 is exerted on the cartridge 36 as a biasing force. Thus, the movable contact member 49 of the apparatus-side connection terminal 46, the seal member 53, and the delivery member 59 constitute the biasing mechanism 41 that biases the cartridge 36 set in the chamber 38 in the upward direction, i.e., in the removal direction. However, since the delivery member 59 is included in the cartridge 36, the delivery member 59 may be excluded from the biasing mechanism 41.

On the cartridge 36, the cartridge-side connection terminal 47 is attached to the sloped face 36*d*. In addition, a positioning hole 62 is provided in the sloped face 36*d* of the cartridge 36 at a position on the side of the bottom face 36*b* from the cartridge-side connection terminal 47, so that the stopper pin 50 can be fitted in the positioning hole 62. Further, an engaging protrusion 63 protruding in the front direction, i.e., toward the operating lever 43, is provided on the sloped face 36*d* of the cartridge 36 at a position on the side of the front face 36*a* from the cartridge-side connection terminal 47.

Hereunder, description will be given on a process of mounting and removing the cartridge 36 on and from the cartridge mounting mechanism 37.

To mount the cartridge 36 on the cartridge mounting mechanism 37, first the carriage 32 is brought to the mounting/removing position. At this stage, the manipulating portion 43*a* of the operating lever 43 provided in the cartridge mounting mechanism 37 is exposed through the cutaway portion 40 in the opening 35.

Before the cartridge 36 is mounted, the operating lever 43 has its lower end portion sticking out into the chamber 38, because of the biasing force of the coil spring 45. When the cartridge 36 is introduced into the chamber 38 and the engaging projection 55 projecting from the rear face 36*c* of the cartridge 36 is fitted in the engagement hole 54, the front edge of the cartridge 36 is made to pivot about the engaging projection 55 by the self-weight of the cartridge 36, so that the engaging protrusion 63 is brought into contact with the engaging portion 43*b* of the operating lever 43. At this stage, the cartridge 36 is located in the removal position in which the upper front end portion of the cartridge 36 is exposed upward from the cartridge inlet 39, as shown in FIG. 4.

Then upon pressing downward the upper front end portion of the cartridge 36 exposed from the cartridge inlet 39, the engaging protrusion 63 of the cartridge 36 presses the sloped portion 43*d* of the operating lever 43, so that the operating lever 43 is made to pivot clockwise in FIG. 4, against the biasing force of the coil spring 45.

At this stage, the cartridge-side connection terminal 47 of the cartridge 36 is brought into contact with the movable contact member 49 of the apparatus-side connection terminal 46, thus to be subjected to a biasing force from the movable contact member 49 which is elastically deformed. In addition, when the liquid delivery port 57 of the cartridge 36 is connected to the liquid introduction path 51, the cartridge 36 is subjected to a biasing force which is the counterforce originating from the elastic deformation of the seal member 53 and the delivery member 59. Further, when the stopper pin 50 is fitted in the positioning hole 62 of the cartridge 36, the cartridge 36 is restricted from moving in the width direction X.

Figure 5:
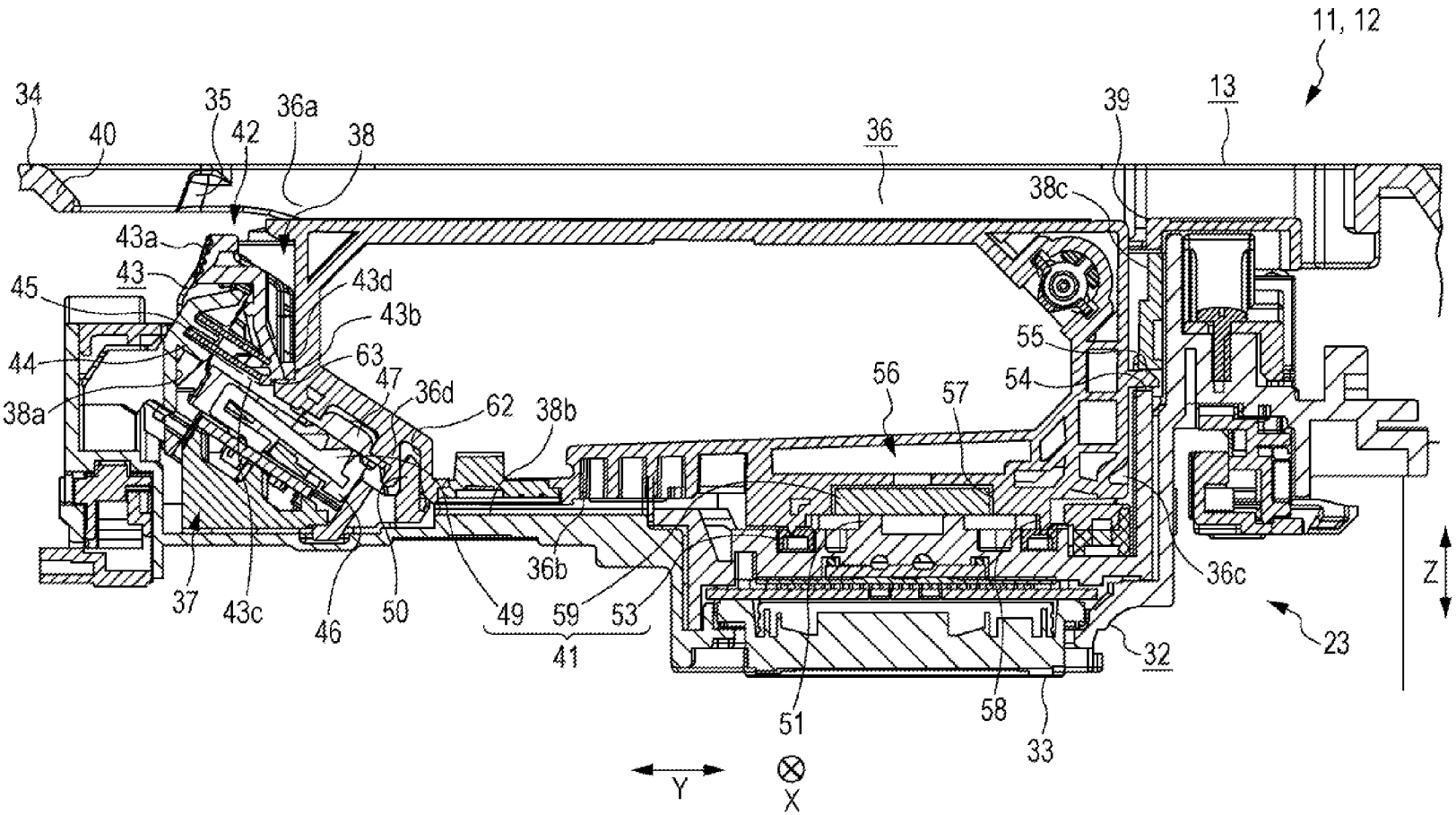
FIG. 5 is a cross-sectional view taken along a line V-V in FIG. 3.

When the cartridge 36 is thus placed in the chamber 38 against the biasing force of the coil spring 45, the movable contact member 49, the seal member 53, and the delivery member 59, the engaging protrusion 63 of the cartridge 36 is displaced to a position under the operating lever 43. Then the operating lever 43 returns to the initial position owing to the biasing force of the coil spring 45, so that the engaging protrusion 63 of the cartridge 36, biased upward by the biasing mechanism 41, is blocked by the engaging portion 43*b* of the operating lever 43 as shown in FIG. 5. In other words, when the cartridge 36 is set in the chamber 38, the holding mechanism 42 serves to retain the cartridge 36 against the biasing force of the biasing mechanism 41 attempting to move the cartridge 36 in the removal direction.

When the cartridge 36 is accommodated in the chamber 38 and the liquid delivery port 57 of the cartridge 36 is connected to the liquid introduction path 51 as described above, the mounting of the cartridge 36 on the cartridge mounting mechanism 37 is completed. As a result, the ink contained in the cartridge 36 can be supplied to the recording head 33 through the liquid introduction path 51, and the recording head 33 becomes ready to perform the recording operation with the ink contained in the cartridge 36 mounted on the cartridge mounting mechanism 37.

Figure 6:
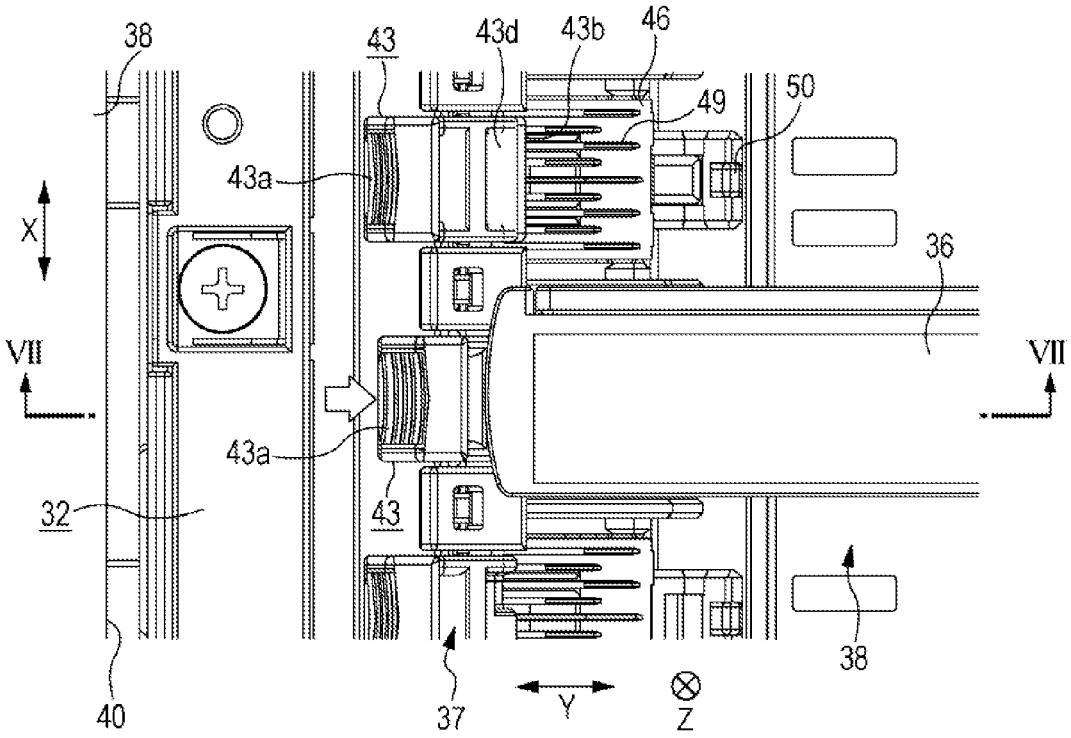
FIG. 6 is a plan view of the cartridge mounting mechanism moved by an operating lever.

Conversely, to remove the cartridge 36 mounted on the cartridge mounting mechanism 37 from the chamber 38, the carriage 32 is brought to the mounting/removing position to expose the manipulating portion 43*a* of the operating lever 43, as in the case of mounting the cartridge 36. Then the manipulating portion 43*a* of the operating lever 43 is pressed backward, as indicated by a blank arrow in FIG. 6.

Figure 7:
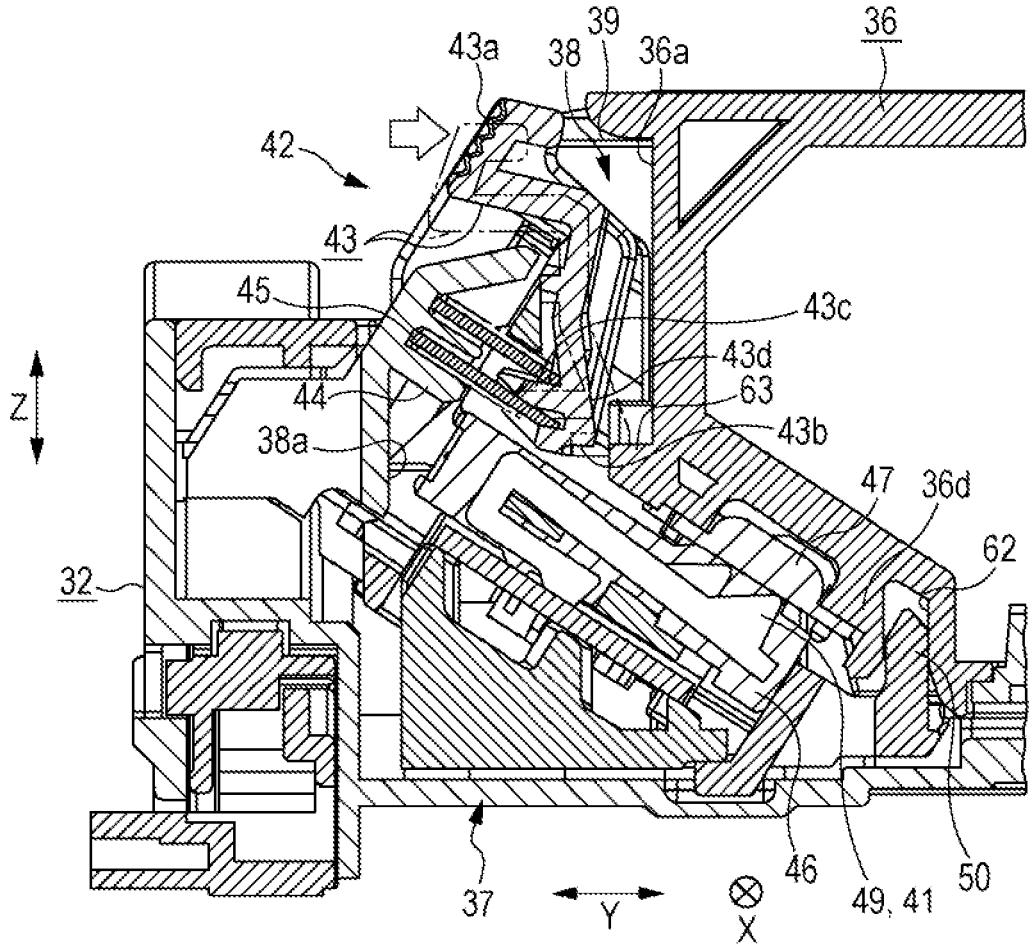
FIG. 7 is a cross-sectional view taken along a line VII-VII in FIG. 6.

At this stage, as shown in FIG. 7, the operating lever 43 is made to pivot clockwise from the engaging position indicated by dash-dot-dot lines to a retracted position indicated by solid lines, so that the engaging portion 43*b* is disengaged from the engaging protrusion 63 of the cartridge 36. In other words, the holding mechanism 42 releases the cartridge 36 from the restriction working against the biasing force of the biasing mechanism 41, when an external operating force is exerted on the manipulating portion 43*a*. It is to be noted that the upper wall 34 is excluded from FIG. 7 for the sake of clearer understanding of the configuration of the carriage 32.

The cartridge 36 thus released from the restriction is displaced upward, i.e., in the removal direction, by the biasing force of the biasing mechanism 41. Here, the biasing mechanism 41 is given a sufficient biasing force to displace the cartridge 36 to the removal position where a part of the cartridge 36 is exposed upward from the cartridge inlet 39, when the cartridge 36 is released from the engagement of the engaging portion 43*b* working against the biasing force. Therefore, the front end portion of the cartridge 36 may be lifted like popping up, depending on the biasing force of the biasing mechanism 41.

When the operating lever 43 is released from the operating force, the operating lever 43 is made to pivot counterclockwise in FIG. 7 by the biasing force of the coil spring 45, and displaced to the engaging position from the retracted position. Therefore, when the cartridge 36 once lifted up by the biasing force of the biasing mechanism 41 is about to descend owing to the self-weight, the sloped portion 43*d* of the operating lever 43 is engaged with the cartridge 36 against the gravity. As a result, the cartridge 36 is retained in the removal position, with an upper portion thereof exposed upward from the cartridge inlet 39 as shown in FIG. 4.

The cartridge mounting mechanism 37 and the recording apparatus 12 configured as above provide the following advantageous effects.

The cartridge 36 is displaced upward by the biasing force of the biasing mechanism 41 when an external operating force is exerted on the manipulating portion 43*a*, and retained in the removal position where an upper portion of the cartridge 36 is exposed upward from the cartridge inlet 39. Accordingly, the user can visually recognize instantly that the cartridge 36 has been released from the holding mechanism 42. In addition, since the upper portion of the cartridge 36 is exposed upward from the cartridge inlet 39 in the removal position, the cartridge 36 can be easily caught for removing the cartridge 36.

Here, in the case where the operating lever working as above is provided on the side of the cartridge, the cartridge is pressed downward via the operating lever when the operating lever is disengaged from the chamber, and therefore the biasing force of the biasing mechanism exerted on the cartridge is partially offset. In this embodiment, in contrast, the operating lever 43 is provided on the side of the cartridge mounting mechanism 37, and therefore the cartridge 36 can be efficiently displaced to the removal position with the biasing force of the biasing mechanism 41.

The operating lever 43 has to have a certain length in order to displace the engaging portion 43*b*. Therefore, in the case where the operating lever is provided on the side of the cartridge, it may be difficult to reduce the size of the cartridge because the length of the operating lever has to be secured. However, since the operating lever 43 is provided on the side of the cartridge mounting mechanism 37 in this embodiment, the cartridge 36 can be made smaller in size. In addition, since the cartridge mounting mechanism 37 is not provided with a member that covers the cartridge inlet 39, the cartridge mounting mechanism 37 can be designed in a smaller size, especially in the up-down direction Z.

Further, manipulating portion 43*a* of the cartridge mounting mechanism 37 is exposed in the cutaway portion 40 when the carriage 32 is located at the mounting/removing position, but covered with the main casing 13 when the carriage is deviated from the mounting/removing position. Such a configuration prevents the cartridge 36 from being accidentally removed during the recording operation.

The foregoing embodiment provides the following advantageous effects.

When the holding mechanism 42 is subjected to an operating force while the cartridge 36 is in the chamber 38, the holding mechanism 42, thus far engaged with the cartridge 36 to restrict the movement thereof, releases the cartridge 36 from the restriction. Accordingly, the cartridge 36 is allowed to move in the removal direction by the biasing force of the biasing mechanism 41. In contrast, although the cartridge 36 is subjected to the biasing force of the biasing mechanism 41 acting in the removal direction while the cartridge 36 is in the chamber 38, the holding mechanism 42 is engaged with the cartridge 36 against the biasing force, to thereby restrict the cartridge 36 from moving in the removal direction. Such a configuration allows the cartridge 36 to be mounted and removed without the need to provide a member that covers the cartridge inlet 39. Consequently, the trouble of opening and closing the member covering the cartridge inlet 39 can be eliminated, and thus the operability in mounting and removing the cartridge 36 can be improved.

The holding mechanism 42 including the operating lever 43 is provided in the chamber 38. Such a configuration allows the cartridge 36 to be made smaller, compared with the case of providing an operating lever having similar functions on the side of the cartridge.

When the cartridge 36 is released from the restriction of the engaging portion 43*b* against the biasing force and thus displaced to the removal position, the cartridge 36 is retained in the removal position because the holding mechanism 42 is engaged with the cartridge 36 against the gravity. Therefore, the user can visually recognize instantly that the cartridge 36 has been released from the restriction against moving in the removal direction. In addition, since a part of the cartridge 36 is exposed upward from the cartridge inlet 39 the cartridge 36 can be easily caught, which leads to improved operability in removing the cartridge 36.

When the lower end portion of the operating lever 43 is made to pivot inwardly of the chamber 38 by the biasing force of the coil spring 45, the sloped portion 43*d* sticks out inwardly of the chamber 38 together with the engaging portion 43*b*. Therefore, the cartridge 36 can be retained in the removal position by the sloped portion 43*d* sticking out inwardly of the chamber 38 as above.

The movable contact member 49 of the apparatus-side connection terminal 46 and the seal member 53 constitute the biasing mechanism 41. Such a configuration eliminates the need to provide an exclusive biasing member that biases the cartridge 36 upward, i.e., in the removal direction.

The main casing 13 covers the manipulating portion 43*a* of the cartridge mounting mechanism 37 in the stroke region of the carriage 32 except for the mounting/removing position, which disables the cartridge 36 from being removed. At the mounting/removing position, on the other hand, the manipulating portion 43*a* can be reached for operation through the cutaway portion 40 in the opening 35.

Second Embodiment

A second embodiment of the recording apparatus will now be described hereunder, focusing on differences from the first embodiment.

Figure 8:
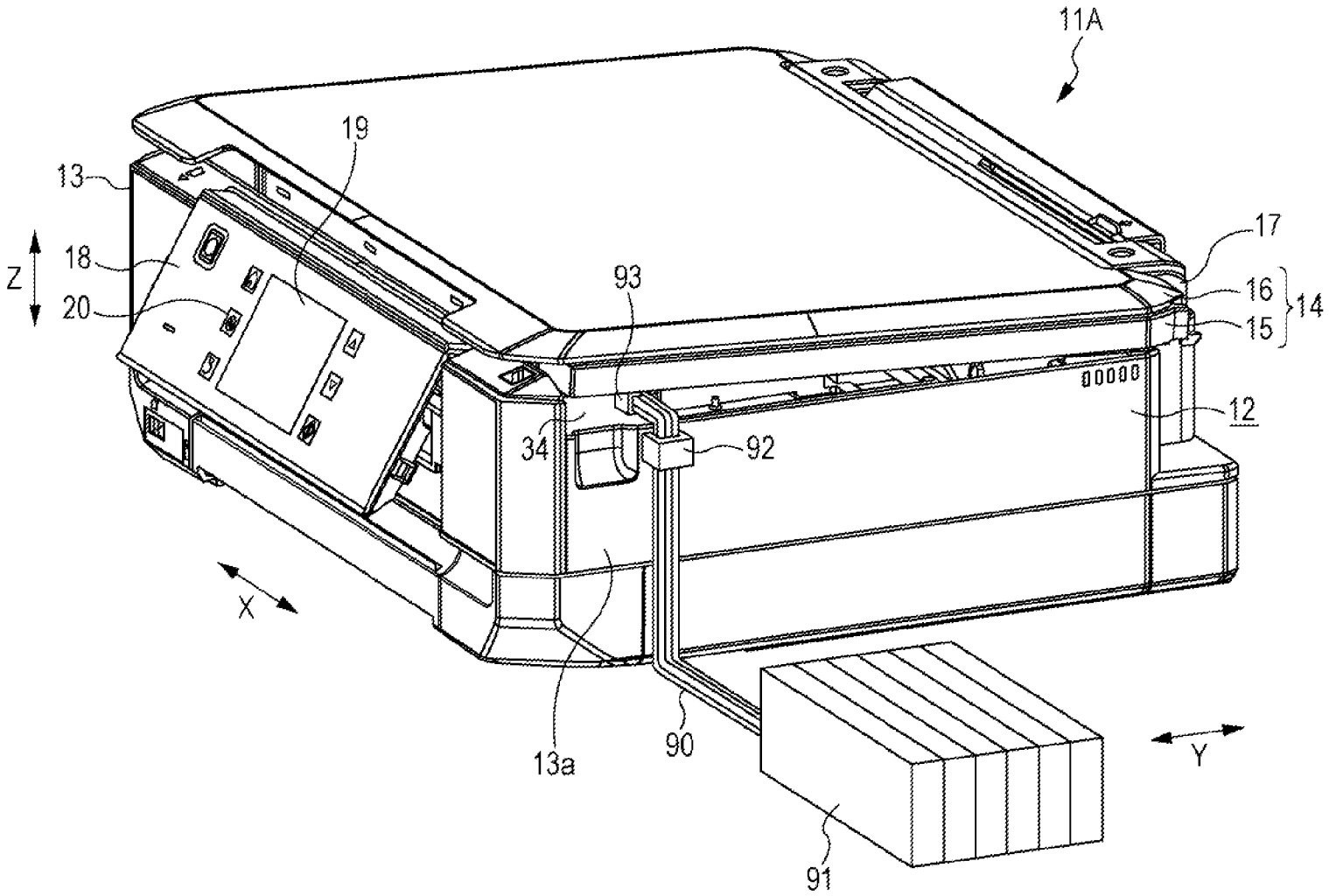
FIG. 8 is a perspective view showing a multifunction printer incorporated with a recording apparatus according to a second embodiment of the invention.

As shown in FIG. 8, a liquid tank 91 provided outside of the main casing 13 is connected to the recording apparatus 12 through a liquid supply tube 90, in a multifunction printer 11A according to this embodiment. The liquid supply tube 90 is fixed with a fastener 92 to a sidewall 13*a* extending in the front-back direction Y and the up-down direction Z on the main casing 13. In addition, a duct 93 is provided between the main casing 13 and the scanner main body 15, for passing the liquid supply tube 90 through the duct 93.

Figure 9:
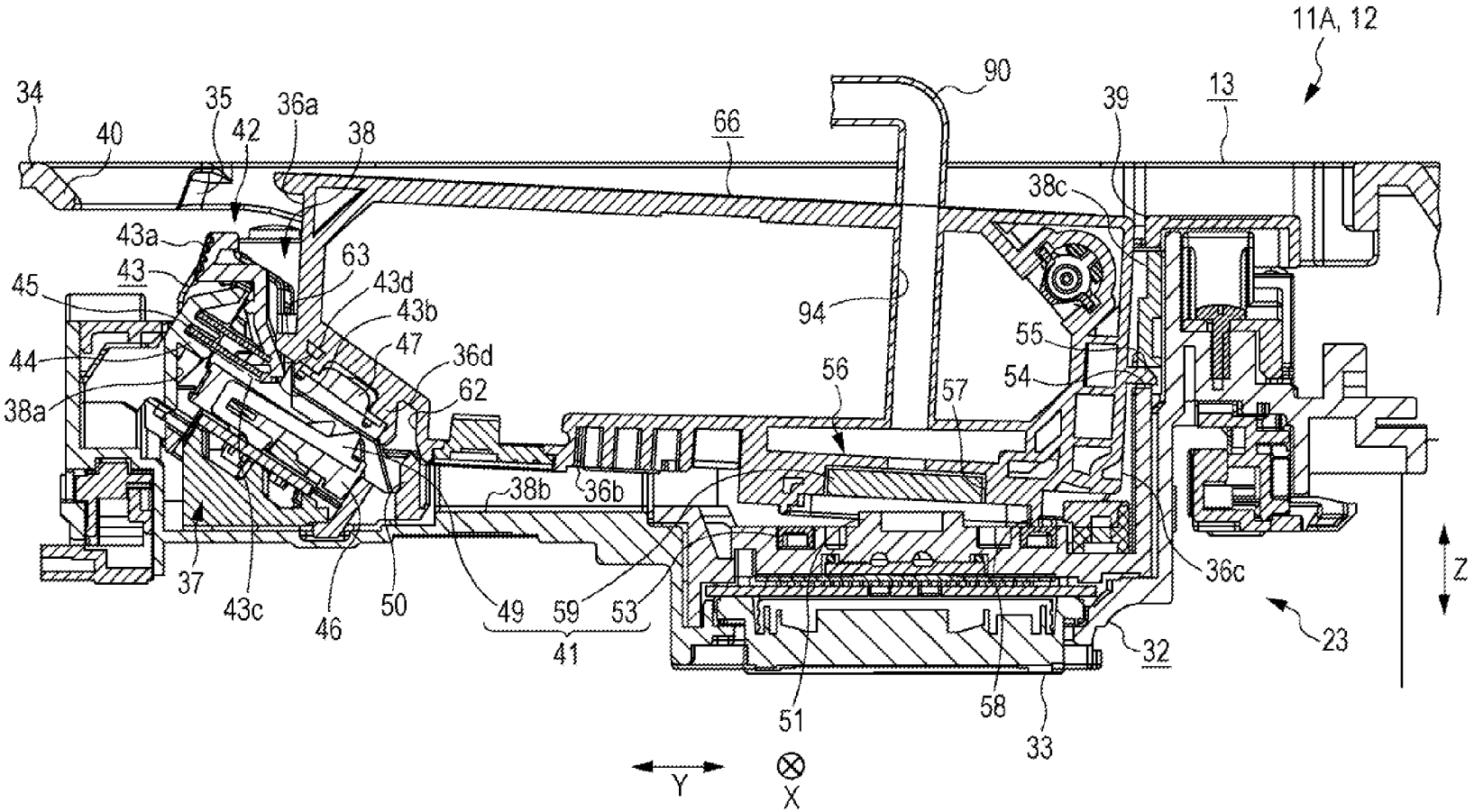
FIG. 9 is a cross-sectional view of a cartridge according to the second embodiment.

As shown in FIG. 9, a cartridge 66 according to this embodiment includes a liquid supply path 94 having the upstream end portion connected to the downstream end portion of the liquid supply tube 90, and the downstream end portion communicating with the liquid delivery port 57.

Figure 10:
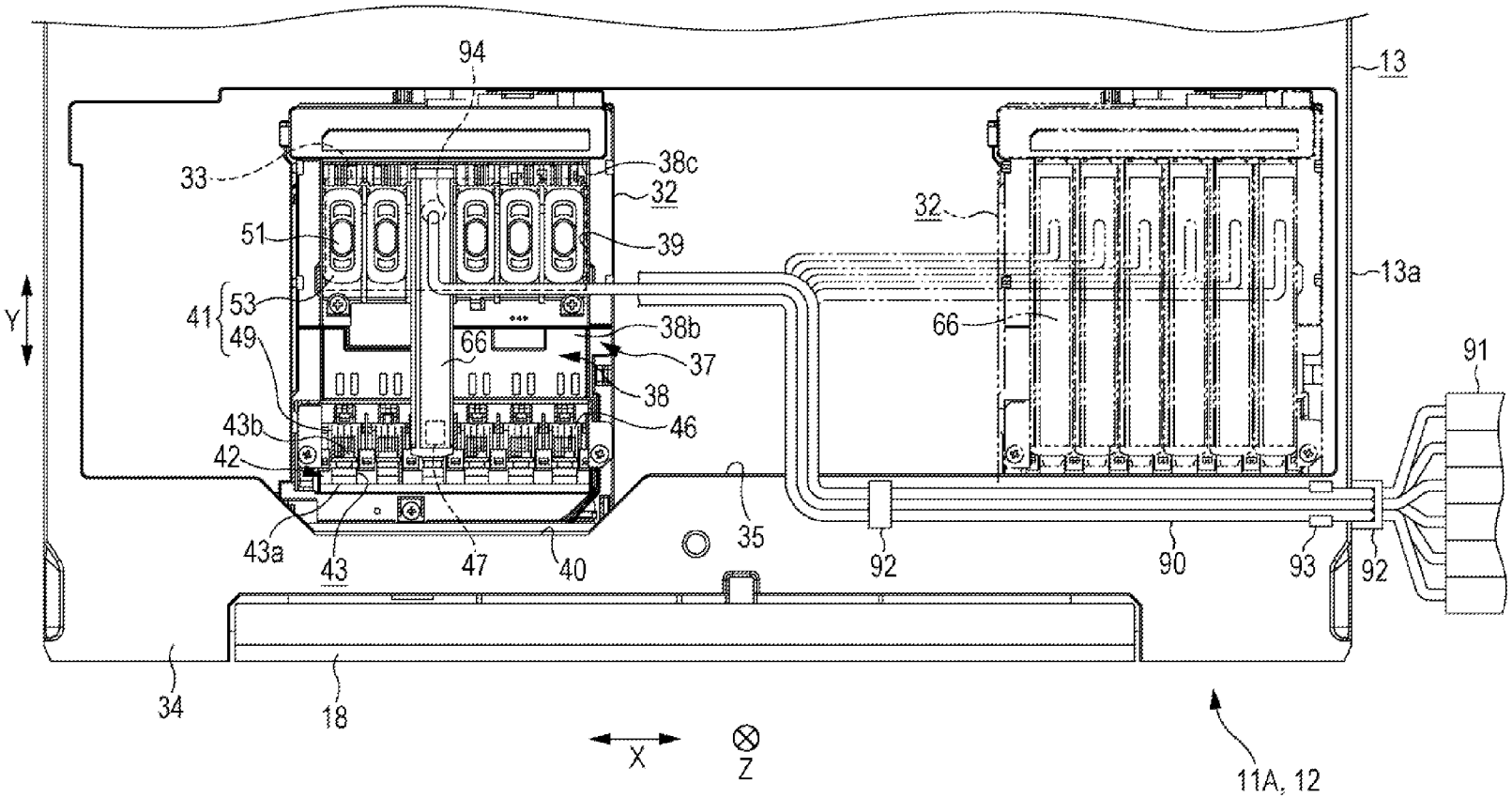
FIG. 10 is a plan view of a main casing according to the second embodiment.

Further, as shown in FIG. 10, the liquid supply tube 90 passed through the duct 93 is routed on the upper face of the upper wall 34 along the front side of the opening 35 in the width direction X and drawn into inside of the opening 35, and then connected to the cartridge 66.

Thus, the liquid supply tube 90 is introduced into the main casing 13 from outside thereof, through the opening 35 formed in the upper wall 34, and connects between the liquid supply path 94 and the liquid tank 91 provided apart from the stroke region of the carriage 32. With such a configuration, the cartridge 66 serves as an intermediate adapter for supplying the ink stored in the liquid tank 91, which is an external tank, to the recording head 33.

The liquid supply tube 90 is fixed to the upper wall 34 with the fastener 92. Further, a plurality of the liquid supply tubes 90 and liquid tanks 91 are provided according to the number of the cartridges 66.

The multifunction printer 11A configured as above provides the following advantageous effects.

In the multifunction printer 11A, mounting the cartridge 66 on the cartridge mounting mechanism 37 allows the ink stored in the liquid tank 91 to be supplied to the recording head 33. In addition, since the liquid tank 91 is located outside of the main casing 13, a larger capacity can be given to the liquid tank 91*a* larger capacity, in which case the recording operation can be successively performed.

Further, since the liquid supply tube 90 is drawn into inside of the main casing 13 through the opening 35, the communication between the liquid tank 91 and the cartridge 66 can be achieved without the need to form an orifice or a cutaway portion in the main casing 13 for introducing the liquid supply tube 90.

The foregoing embodiment provides the following advantageous effects, in addition to those mentioned above.

Mounting the cartridge 66 including the liquid supply path 94 on the cartridge mounting mechanism 37 allows the ink stored in the liquid tank 91 located outside of the stroke region of the carriage 32 to be supplied to the recording head 33 through the liquid supply tube 90. Supplying thus the ink from the liquid tank 91 having a larger capacity than the cartridge 36 containing the ink allows the recording operation to be successively performed.

Since the main casing 13 includes the opening 35, the liquid supply tube 90 can be introduced into the main casing 13 through the opening 35 from outside of the main casing 13. Further, since the liquid tank 91 is located outside of the main casing 13, the shape and the capacity of the liquid tank 91 can be designed free from the restriction otherwise imposed by the shape and size of the main casing 13.

The foregoing embodiments may be modified as follows.

In the operating lever 43, the engaging portion 43*b* may be located between the pivotal center and the manipulating portion 43*a*. The operating lever 43 may be configured such that the engaging portion 43*b* is displaced in the width direction X to be engaged with the cartridge 36.

The biasing member that biases the operating lever 43 may be a leaf spring, a rubber member, or the like, in place of the coil spring.

The sloped portion 43*d* may be excluded from the operating lever 43, and a separately provided member may be made to stick out into the chamber 38 to retain the cartridge 36 in the removal position, when the cartridge 36 is disengaged from the engaging portion 43*b*. In this case, the operating lever 43 may be configured to be elastically deformed upon being subjected to an external operating force, so that the engaging portion 43*b* is displaced.

The biasing mechanism 41 may include an exclusive biasing member (for example, a coil spring or a leaf spring) for moving the cartridge 36 upward, in addition to the movable contact member 49 and the seal member 53. In this case, the apparatus-side connection terminal 46 may be located on the inner front wall 38*a* or the inner rear wall 38*c* of the chamber 38.

In the first embodiment, the cartridge 36 to be mounted on the cartridge mounting mechanism 37 may be a waste ink cartridge for storing waste ink discharged from the recording head 33, or a cartridge containing a functional fluid such as a cleaning fluid for washing the recording head 33, instead of the cartridge containing the recording liquid. Alternatively, the cartridge 36 may be a dummy cartridge (empty cartridge) to be mounted on a vacant space in the chamber 38.

The opening 35 may be formed in the main casing 13 only at the position corresponding to the mounting/removing position to expose the cartridge inlet 39 and the manipulating portion 43*a*, so that the main casing 13 covers the cartridge inlet 39 and the manipulating portion 43*a* in the region other than the mounting/removing position. Covering thus the cartridge inlet 39 and the manipulating portion 43*a* with the main casing 13 in the region other than the mounting/removing position disables the cartridge 36 from being reached for removal.

In the second embodiment, the shape, location, or number of the fasteners 92 and ducts 93 may be modified as desired. Alternatively, either or both of the fastener 92 and the duct 93 may be excluded.

In the second embodiment, a through hole or a cutaway portion may be formed in the sidewall 13*a* of the main casing 13, to introduce the liquid supply tube 90 into inside of the main casing 13 through the through hole or the cutaway portion.

In the second embodiment, the routing of the liquid supply tube 90 may be modified as desired. For example, the liquid supply tube 90 may be routed along the rear side of the opening 35 on the upper wall 34.

In the second embodiment, the liquid tank 91 may be located inside of the main casing 13. In the case where the recording apparatus is without the scanner unit 14, the liquid tank 91 may be located on top of the upper wall 34.

In the second embodiment, the liquid tank 91 may be fixed to the main casing 13, or located with a spacing from the main casing 13.

In the case where a plurality of liquid tanks 91 are provided in the second embodiment, the liquid tanks 91 may be placed together or apart from each other.

In the case where monochrome printing is performed in the second embodiment, only the cartridge 66 connected to the liquid tank 91 storing black ink may be mounted on the cartridge mounting mechanism 37. To perform the monochrome printing under such setting, the cartridge 36 containing a color ink may be mounted on a position in the chamber 38 corresponding to the color ink, or the positions in the chamber 38 corresponding to color inks may be left vacant without mounting the cartridges 36 or 66.

In the second embodiment, the liquid supply tube 90 may be constituted of a flexible tube in a portion that follows the movement of the carriage 32, and a less flexible liquid supply tube or a liquid supply member may be employed in a portion free from flexural displacement, such as the portion fixed to the main casing 13. Thus, the liquid supply tube 90 may constituted of a single tubular member or a plurality of tubular members connected to each other.

In the second embodiment, the liquid tank 91 may be of a refillable type, or may be provided with a replaceable pack.

The medium may be a resin film, a metal plate, or a cloth, without limitation to the paper sheet.

The recording apparatus 10 according to the foregoing embodiments broadly encompasses a fluid ejecting apparatus that ejects a liquid other than the ink, such as an ordinary liquid, a liquid containing particles of a functional material dispersed or mixed therein, or a gel-like fluid. Examples of such fluid ejecting apparatuses include those that eject a liquid containing, dispersed or dissolved therein, an electrode material or a color material (pixel material) for manufacturing LCDs, electroluminescence displays or field emission displays, those that eject a gel-like fluid such as a physical gel, and those that eject a particulate or powder material such as a toner, typically exemplified by a toner jet recording apparatus. The invention is applicable to any of those fluid ejecting apparatuses. The term "fluid" herein referred to implies a liquid (solvent including an organic and inorganic solvent, liquid resin, liquid metal (metal melt)), a sol, a gel, a particulate or powder material (particles and powder), and so forth.

Further, the foregoing embodiments and the variations thereof lead to the following technical idea.

A recording apparatus may include a cartridge mounting mechanism to which a cartridge containing a recording material is removably attached, a recording head that performs a recording operation with the recording material contained in the cartridge set in the cartridge mounting mechanism, a carriage that reciprocates in a main scanning direction with the recording head and the cartridge mounting mechanism mounted thereon, and a main casing including an opening located above the stroke region of the carriage and having a shape corresponding to the stroke region. The opening may include a cutaway portion formed at a mounting/removing position of the cartridge in the main scanning direction, so as to allow the manipulating portion of the cartridge mounting mechanism to be exposed, and the main casing covers the manipulating portion in a region other than the mounting/removing position.

With the mentioned configuration, the main casing covers the manipulating portion in the stroke region of the carriage, at positions other than the mounting/removing position, which disables the cartridge from being removed. At the mounting/removing position, on the other hand, the manipulating portion can be reached for operation through the cutaway portion in the opening.

The entire disclosure of Japanese Patent Application No. 2012-152568 filed on Jun. 6, 2012, and No. 2012-178281 filed on Aug. 10, 2012, are expressly incorporated by reference herein.

What is claimed is:

1. A recording apparatus comprising:

a recording head that ejects a liquid;

a cartridge mounting mechanism including:

(i) a chamber that accommodates therein a cartridge introduced through a cartridge inlet of the chamber, the cartridge inlet being an opening directed upward, (ii) a biasing mechanism that biases the cartridge set in the chamber in an upward direction corresponding to a removal direction of the cartridge, and (iii) a holding mechanism configured to be (a) engaged with the cartridge so as to restrict, against a biasing force of the biasing mechanism, the cartridge from moving in the removal direction when the cartridge is set in the chamber, and (b) disengaged from the cartridge to release the cartridge from the restriction against the biasing force, upon being subjected to an external operating force; and a carriage that reciprocates in a main scanning direction, with the recording head and the cartridge mounting mechanism mounted thereon, wherein the holding mechanism includes an operating lever pivotably attached to the chamber at a position close to the cartridge inlet, wherein the operating lever includes a sloped portion inclined inwardly of the chamber and formed from a position close to the pivotal center toward the engaging portion, and the holding mechanism further includes a biasing member that biases a lower end portion of the operating lever toward an inner region of the chamber.

2. The recording apparatus according to claim 1, wherein the operating lever includes a manipulating portion located in an upper region of the pivotal center to be subjected to an external operating force, and an engaging portion located in a lower region of the pivotal center to be engaged with the cartridge.

3. The recording apparatus according to claim 1, wherein the biasing mechanism possesses a biasing force sufficient to allow the cartridge to move, when the cartridge is released from the restriction of the engaging portion against the biasing force, to a removal position where a part of the cartridge is exposed upward from the cartridge inlet, and the holding mechanism is configured to be engaged, against the gravity, with the cartridge that has been moved by the biasing force of the biasing mechanism, to thereby retain the cartridge in the removal position.

4. The recording apparatus according to claim 1, further comprising an apparatus-side connection terminal, wherein the cartridge includes a cartridge-side connection terminal, the apparatus-side connection terminal includes a movable contact member disposed to stick out to an inner portion of the chamber when the cartridge is not accommodated and to be elastically deformed upon being contacted by the cartridge-side connection terminal of the cartridge introduced into the chamber, to an extent according to a contact pressure of the cartridge-side connection terminal, and the movable contact member acts as the biasing mechanism.

5. The recording apparatus according to claim 1, wherein the chamber includes an elastically deformable seal member, and the seal member acts as the biasing mechanism.

6. The recording apparatus according to claim 1, wherein the cartridge includes a delivery member through which the liquid is delivered, and the delivery member acts as the biasing mechanism.

7. The recording apparatus according to claim 1, further comprising a main casing including an opening located above the stroke region of the carriage in the main scanning direction and having a shape corresponding to the stroke region, wherein the opening includes a cutaway portion formed at a position corresponding to a mounting/removing position of the cartridge in the main scanning direction, so as to allow the manipulating portion of the cartridge mounting mechanism to be exposed, and the main casing covers the manipulating portion in a region other than the mounting/removing position.

8. A recording apparatus comprising:

a recording head that ejects a liquid;

a cartridge mounting mechanism including:

(i) a chamber that accommodates therein a cartridge introduced through a cartridge inlet of the chamber, the cartridge inlet being an opening directed upward, (ii) a biasing mechanism that biases the cartridge set in the chamber in an upward direction corresponding to a removal direction of the cartridge, and (iii) a holding mechanism configured to be (a) engaged with the cartridge so as to restrict, against a biasing force of the biasing mechanism, the cartridge from moving in the removal direction when the cartridge is set in the chamber, and (b) disengaged from the cartridge to release the cartridge from the restriction against the biasing force, upon being subjected to an external operating force;

a carriage that reciprocates in a main scanning direction, with the recording head and the cartridge mounting mechanism mounted thereon, a liquid tank provided outside of the stroke region;

a liquid supply tube connecting between the liquid tank and the cartridge; and a main casing including an opening located above the stroke region of the carriage and having the shape corresponding to the stroke region, wherein the liquid tank is located outside of the main casing, and the liquid supply tube is introduced into the main casing through the opening from outside of the main casing.

9. A recording apparatus comprising:

a recording head that ejects a liquid;

a cartridge mounting mechanism including:

(i) a chamber that accommodates therein a cartridge introduced through a cartridge inlet of the chamber, the cartridge inlet being an opening directed upward, (ii) a biasing mechanism that biases the cartridge set in the chamber in an upward direction corresponding to a removal direction of the cartridge, and (iii) a holding mechanism configured to be (a) engaged with the cartridge so as to restrict, against a biasing force of the biasing mechanism, the cartridge from moving in the removal direction when the cartridge is set in the chamber, and (b) disengaged from the cartridge to release the cartridge from the restriction against the biasing force, upon being subjected to an external operating force; and a carriage that reciprocates in a main scanning direction with the recording head and the cartridge mounting mechanism mounted thereon, wherein the cartridge can be retained in the removal position by an operating lever sticking out inwardly of the chamber.

* * * * *